US010912973B2

(12) United States Patent
Rife

(10) Patent No.: US 10,912,973 B2
(45) Date of Patent: Feb. 9, 2021

(54) WEIGHTED GOLF GRIP

(71) Applicant: Guerin D. Rife, Carlsbad, CA (US)

(72) Inventor: Guerin D. Rife, Carlsbad, CA (US)

( * ) Notice: Subject to any disclaimer, the term of this patent is extended or adjusted under 35 U.S.C. 154(b) by 0 days.

(21) Appl. No.: 16/023,672

(22) Filed: Jun. 29, 2018

(65) Prior Publication Data

US 2018/0369669 A1 Dec. 27, 2018

Related U.S. Application Data

(63) Continuation-in-part of application No. 15/483,982, filed on Apr. 10, 2017, now abandoned.

(51) Int. Cl.

| | |
|---|---|
| ***A63B 53/14*** | (2015.01) |
| ***A63B 60/24*** | (2015.01) |
| ***A63B 1/00*** | (2006.01) |
| *A63B 60/08* | (2015.01) |

(52) U.S. Cl.

CPC ..... *A63B 60/24* (2015.10); *A63B 1/00* (2013.01); *A63B 53/14* (2013.01); *A63B 60/08* (2015.10)

(58) Field of Classification Search

CPC ..... A53B 60/24; A53B 53/14; A53B 60/08; A63B 60/12; A63B 60/14; A63B 60/24; A63B 1/00; A63B 53/14; A63B 60/08; A63B 60/16; A63B 60/02; A63B 2209/10

See application file for complete search history.

(56) References Cited

U.S. PATENT DOCUMENTS

| | | | | |
|---|---|---|---|---|
| 1,289,553 | A | | 12/1918 | Sanders |
| 1,337,958 | A | | 4/1920 | Reach |
| 1,536,616 | A | | 5/1925 | Manning |
| 1,965,954 | A | | 4/1930 | Davis |
| 2,005,401 | A | | 6/1935 | Storz |
| D122,795 | S | | 10/1940 | Geerlings |
| D148,193 | S | | 12/1947 | Smith |
| 3,869,126 | A | | 3/1975 | Thompson |
| 4,413,825 | A | | 11/1983 | Sasse |
| 4,461,479 | A | * | 7/1984 | Mitchell ..... A63B 60/24 473/292 |
| 4,468,034 | A | | 8/1984 | Duclos |
| 4,508,349 | A | | 4/1985 | Gebauer et al. |
| 4,690,407 | A | | 9/1987 | Reisner |
| 4,964,641 | A | | 10/1990 | Miesch et al. |
| 4,988,102 | A | | 1/1991 | Reisner |
| 5,171,017 | A | | 12/1992 | Betancourt |
| 5,203,453 | A | | 4/1993 | Dirito |
| 5,224,497 | A | | 7/1993 | Ehlers |
| 5,244,209 | A | | 9/1993 | Benzel |
| 5,299,807 | A | | 4/1994 | Hutin |
| 5,354,059 | A | | 10/1994 | Stuff |
| 5,397,127 | A | | 3/1995 | Kawada et al. |
| 5,618,239 | A | | 4/1997 | Rife |

(Continued)

OTHER PUBLICATIONS

Truth digest Mygolfspy, Machine M2A Converter Putter—Part 1, the Story and the Putter, https://forum.mygolfspy.com/topic/4634-machine-m2a-converter-putter-%E2%80%93-part-1-%E2%80%93-the-story-and-the-putter/, Nov. 2011.

*Primary Examiner* — Stephen L Blau

(74) *Attorney, Agent, or Firm* — Dickinson Wright PLLC

(57) ABSTRACT

A golf grip having a weighted rear, longitudinal underside section providing a high Moment of Inertia to increase resistance to twisting and turning when the grip is connected to a golf club during the execution of a golf shot.

17 Claims, 2 Drawing Sheets

(56) References Cited

U.S. PATENT DOCUMENTS 5,637,044 A 6/1997 Swash
5,688,186 A 11/1997 Michaels et al.
5,688,190 A 11/1997 Rowland et al.
5,709,616 A 1/1998 Rife
5,779,560 A 7/1998 Buck et al.
5,785,610 A 7/1998 Birmingham
D398,357 S 9/1998 De La Cruz et al.
5,967,903 A 10/1999 Cheng
5,984,801 A 11/1999 Mason
6,004,224 A * 12/1999 Tanaka ..... A63B 53/10 473/297
6,110,057 A 8/2000 McKinnon
6,183,379 B1 2/2001 Kim et al.
6,193,614 B1 2/2001 Sasamoto et al.
6,224,497 B1 5/2001 Antonious
6,257,994 B1 7/2001 Antonious
6,368,231 B1 4/2002 Chen
6,419,593 B1 7/2002 Heinrich et al.
6,511,386 B1 * 1/2003 Cacicedo ..... A63B 49/08 473/300
6,758,759 B2 7/2004 Gobush et al.
6,779,277 B2 8/2004 Sones
6,799,377 B2 10/2004 Sones
6,849,004 B2 2/2005 Lindsay
6,966,846 B2 * 11/2005 Bloom, Jr. ..... A63B 53/007 473/292
7,056,226 B2 6/2006 Kennedy
7,621,828 B2 11/2009 Voges
7,635,310 B2 * 12/2009 Keough ..... A63B 53/14 473/297
8,066,586 B2 11/2011 Solheim et al.
8,337,324 B2 12/2012 ISander et al.
8,366,566 B1 2/2013 Rollinson
8,678,945 B2 * 3/2014 Rice ..... A63B 53/10 473/316
8,790,193 B2 7/2014 Serrano et al.
8,986,132 B2 3/2015 Chen
8,986,133 B2 3/2015 Bennett
9,522,313 B2 * 12/2016 Betts ..... A63B 53/10
2003/0008731 A1 1/2003 Anderson et al.
2003/0157995 A1 8/2003 Mahaffey
2003/0207241 A1 * 11/2003 Manual ..... A63B 53/14 434/252
2003/0236128 A1 * 12/2003 Jackson ..... A63B 53/007 473/244
2004/0030527 A1 2/2004 Rankin
2004/0259659 A1 * 12/2004 Enlow ..... A63B 53/14 473/300
2005/0020376 A1 1/2005 Huang
2005/0026717 A1 2/2005 Jones
2005/0164806 A1 7/2005 Solheim
2005/0181888 A1 8/2005 Hou
2006/0189414 A1 8/2006 Voges et al.
2006/0199661 A1 9/2006 Deng
2006/0211514 A1 9/2006 Deshmukh
2007/0049403 A1 3/2007 Chen
2007/0072698 A1 3/2007 Juang
2007/0135229 A1 6/2007 Lo
2008/0009363 A1 1/2008 Solodovnick
2008/0076597 A1 3/2008 Roach
2008/0096687 A1 4/2008 Chen
2008/0234066 A1 9/2008 Jones
2009/0005191 A1 1/2009 Lin
2009/0156328 A1 6/2009 Reese
2010/0087269 A1 4/2010 Snyder
2011/0009211 A1 1/2011 Chao
2011/0039636 A1 2/2011 Cackett
2012/0196700 A1 8/2012 Rollinson
2013/0047453 A1 2/2013 Rife
2013/0072321 A1 3/2013 Morales
2013/0324301 A1 12/2013 Boyd
2014/0200097 A1 * 7/2014 Chu ..... A63B 53/007 473/303
2014/0274454 A1 9/2014 Snyder
2015/0045136 A1 12/2015 Boccieri
2016/0287956 A1 * 10/2016 Wang ..... A63B 60/14
2017/0165542 A1 * 6/2017 Davis ..... A63B 53/14
2018/0311548 A1 * 11/2018 Nicolette ..... A63B 53/08

* cited by examiner

FIG. 1
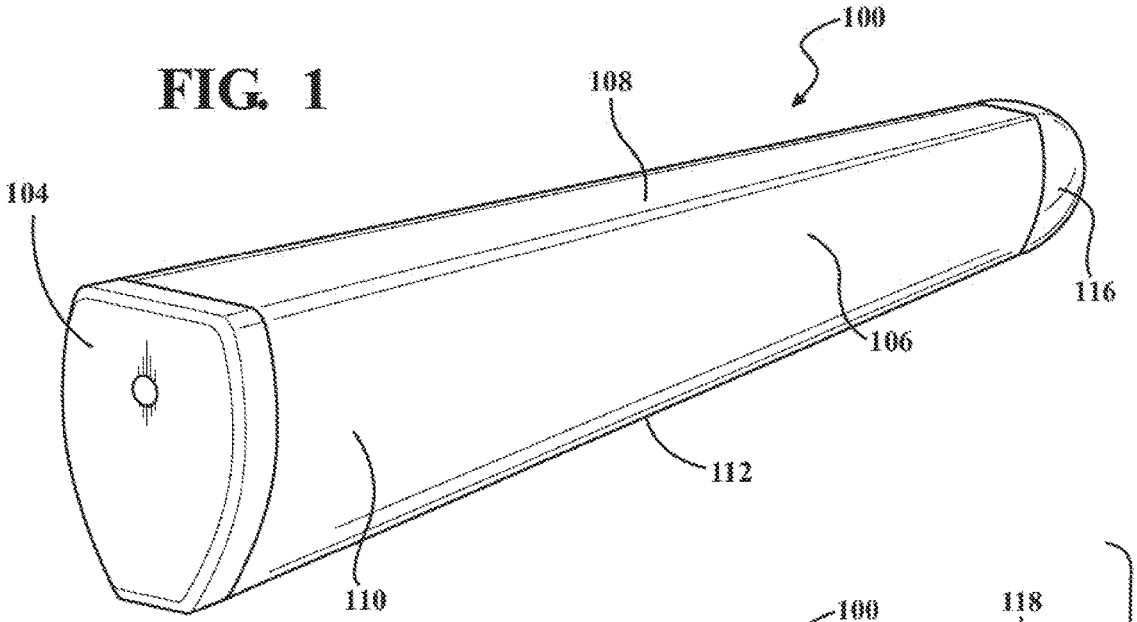
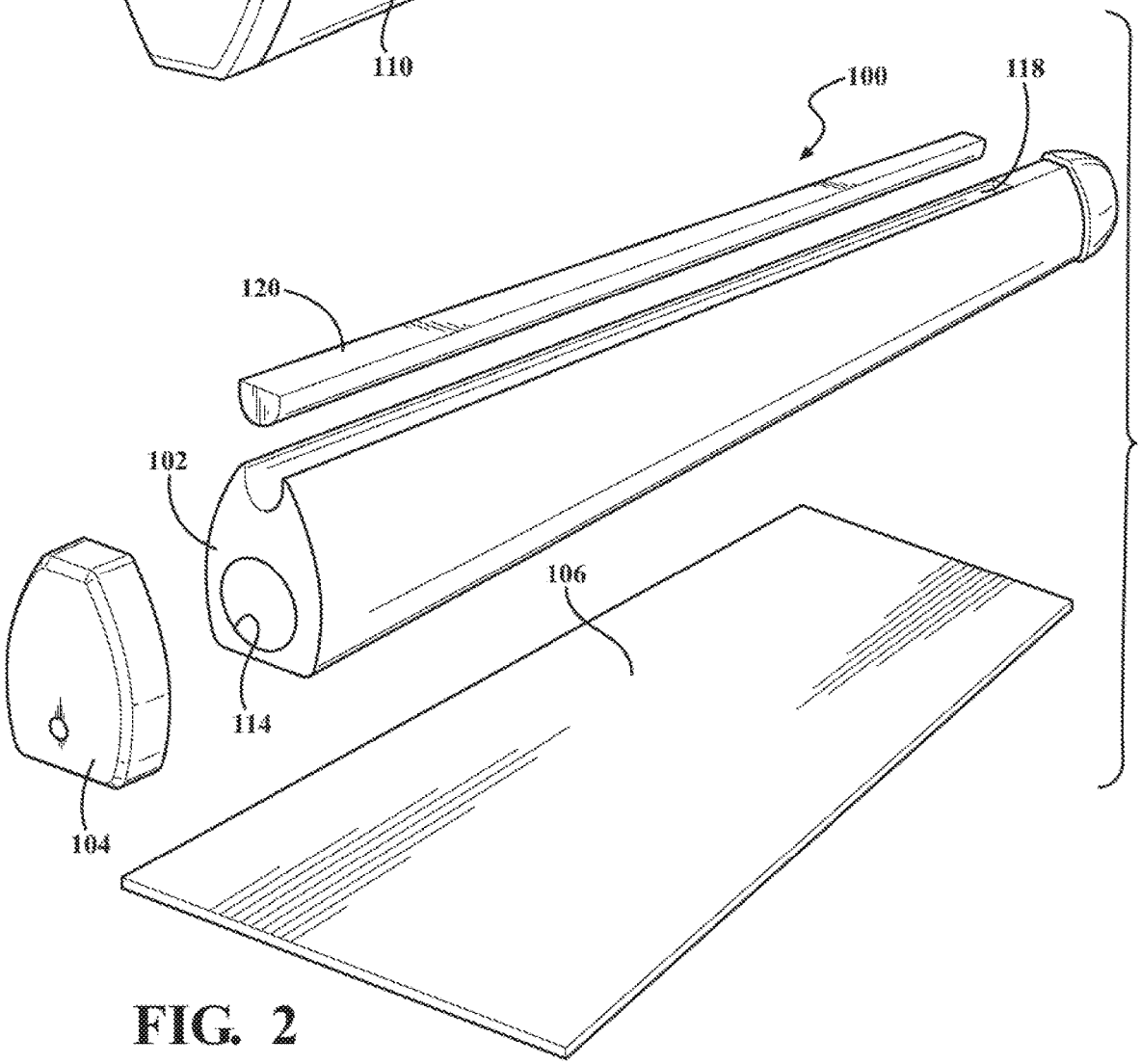
FIG. 2

WEIGHTED GOLF GRIP

CROSS REFERENCE TO RELATED APPLICATIONS

This U.S. Continuation in part application claims the benefit of U.S. Continuation application Ser. No. 15/483,982, filed Apr. 10, 2017, the entire contents of each which are incorporated herein by reference in their entirety.

FIELD OF INVENTION

The present invention relates to golf grips and in particular to a weighted golf grip that has a high resistance to twisting and torque thereby increasing the stability of the golf grip.

BACKGROUND OF INVENTION

It is well known to add weight to the grip portion of a golf club for various purposes such as balancing the overall club weight or the swing weight of a golf club. Typically, weight is added to the upper or butt portion of the grip for these purposes.

U.S. Pat. No. 7,635,310 to Keough discloses the use of a plurality of weight members in a longitudinal channel formed in a grip for balancing the face of a putter.

U.S. Pat. Nos. 4,690,407 and 4,988,102 to Reisner are directed to golf grips having a weight attached to the upper butt end of the grip to control swing weight and counter balance the weight of the club head and shaft.

Application number 2015/0045136 to Boccieri is one of a typical number of grips using a grip weight to balance shaft and head weight of a putter type golf club.

U.S. Pat. No. 5,244,209 to Benzel uses weight at the upper end of a grip for swing weight adjustment.

Application Number 2008/0009363 to Solodovnick shows a variety of longitudinal weight members in a golf grip.

U.S. Pat. No. 6,511,386 to Cacicedo discloses a golf grip with stiffening rods imbedded therein.

SUMMARY OF INVENTION

The present invention represents a grip structure that increases the Moment of Inertia, hereinafter MOI, of a golf club by positioning a majority of the overall weight of the grip further away from the shaft or center of torque of the grip thereby reducing the twisting and turning of the club as a golf ball is struck. In accordance with the present invention, the overall design and structure is similar to conventional grips and includes a grip body having a closed upper butt section, and a shaft opening at the lower end of the grip that extends essentially the entire length of the grip for attachment to a golf club shaft. The grip body includes a longitudinal channel to accommodate a rear weight imbedded into the channel at the rear, longitudinal underside of the grip body. In a preferable embodiment, the weighting material is a permanently installed, elongated rod, shaped to conform and fit into the complimentary channel cut into or formed at the rear underside of the grip body. The weight is located longitudinally between the upper butt section of the grip and the lower opening along an extreme outer edge of and at the underside of the grip body directly below the shaft and oriented parallel to the putter face.

Preferably, the weight has an outer shape that conforms to the outer shape of the grip body. The center of the weighted rod is only located directly below and in-line with the center of a shaft opening located along a frontal portion of the grip. In a preferred embodiment, the grip may include an outer, thin over listing or wrap made of light weight material that covers the grip body and the outer portion of the rear weight.

The grip body preferably is made with a light weight material, such as EVA foam or other similar light weight material, having a total weight of approximately 45 grams. The elongated weighted rod may be made of steel, lead or a similar heavy metal material having an overall weight of 50 to 170 grams that preferably is approximately 65 grams. The EVA foam material is at least 50 times lighter per cube inch of material than the material weight for a given cube inch of the heavy metal material. For example, a one inch cube of EVA foam has significantly less weight than a corresponding one inch cube of steel weight material and will be approximately 50 to 85 times lighter. It will be appreciated that if a heavier metal, such as lead or tungsten, is used the EVA foam material becomes even lighter, as much as 220 times lighter than the imbedded rear weight material.

It follows that the total weight of the grip body, although much larger in volume than the imbedded rear weight, is less than the weight of the much smaller, elongated rod in the lowermost rear section of the grip body. When an outer wrap or listing is used, primarily for esthetic reasons and/or to provide a specific gripping surface, this outer listing is no greater than 15 grams. Thus, even with the use of an outer listing, the rod weight is greater than the rest of the grip. In combination, the weighted rod and the lower rear portion of the grip body in which the weight is embedded, forms about 70% of the total weight of the assembled grip located below the center and to the rear of the shaft opening.

Another feature of the invention is that the weighted rod at the rear, longitudinal underside of the grip is spaced away from and is located on only a bottom side of the shaft away from where the center of torque of the putter is normally located. Preferably the weighted rod is at least 15 mm from the center of the shaft opening and that distance is at least 60% of the total distance between the front of the grip and the rear of the grip.

When the grip is properly positioned on the shaft of a putter, the rear, longitudinal underside section of the grip is located downward when the putter is properly aligned and, in turn, the top of the grip faces upward during a normal putting stroke. In this position, a line drawn through the center of the shaft opening and the center of the weight member is parallel to the face of the putter so the face can easily be manipulated by the golfer to be at a square position relative to an intended target line. The heavy weight at the lower, rear of the putter grip assists in keeping the putter face square to the line position during the execution of a putting stroke as a result of the increased MOI of the grip that tends to stabilize the putter.

In a typical size grip, the length is 287 mm or 11.25 inches. The grip width is 26 mm or one inch and the depth is 32 mm or 1.25 inches. The center of the shaft opening is located 14 mm from the front top surface of the grip and the weighted rod is at least 15 mm, and preferably at least 17 mm, from the center of the shaft opening. The greater distance between the weighted rod and the center of the shaft opening creates a moment arm that increases the MOI of the grip that increases resistance to torque and twisting and this assists a golfer to maintain a square face to the path during the execution of a putting stroke.

In use, a golfer takes the putter grip loosely in the hands and allows the grip and the attached putter to fall to a natural position due to gravity. The grip is structured so that when a golf club or golf putter is used in a normal position, the weight at the rear, longitudinal underside section of the grip is the part of the grip that is the lowest toward the ground and a line intersecting the center of the weight member and the shaft opening is parallel with the face of the putter and perpendicular to the intended target line when the putter is allowed to assume a true gravity position. The higher MOI, or resistance to torque and turning of the grip, makes it easier to maintain a stable, aligned position and aids in preventing rotation during the execution of a putting stroke. Therefore, it follows the grip of the present invention creates a superior result by assisting the golfer to feel the face angle of the putter and, in turn, to maintain a perpendicular angle to the direction of the stroke path.

Whereas the benefits of the grip structure of this invention are likely to make only subtle improvements in maintaining the golf club in a stable position, it will be appreciated that extremely minor face position changes usually make a major difference in the final resting point of a golf ball struck at distances of 20 or 30 feet and even longer lengths. In addition, because the putting stroke is relatively soft and creates much less impact force against a golf ball, as compared to a full swing golf shot, the smallest nuance during the putting stroke can make a significant difference in the ability of the golfer to make a smooth and confident putting stroke ultimately resulting in the golfer making more putts. It follows, a feeling of stability is created with the higher MOI of the grip that is extremely beneficial to the golfer by creating a more stable and balanced feel in the golfer's hands that is most important to the proper execution of a putting stroke.

Among the objects of the invention is the provision of a golf grip having a weighted rear, longitudinal underside section to increase the MOI of the golf club to which the grip is attached.

Another object is the provision of a golf grip that increases resistance to torque and twisting when a golf ball is struck by a golf club to which the golf grip is attached.

Yet another object is the provision of a golf grip that promotes a square face of the putter through the entire stroke path.

Still another object is the provision of a golf grip having a lower, rear longitudinal weight that is at least the same weight as the remainder of the grip.

Another object is the provision of a golf grip having a lower, rear longitudinal weight member that is at least 50 times heavier for a given volume of material than the remainder of the grip body.

An object of the invention is a grip structure to provide feedback that enables a golfer to feel the alignment of the face during the execution of a putting stroke.

These and other objects of the invention will be apparent with reference to the following drawings and accompanying written specification.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 illustrates an assembled golf grip of the present invention.

FIG. 2 illustrates an exploded view of the golf grip of FIG. 1.

DETAILED DESCRIPTION OF EXAMPLE EMBODIMENTS

Figure 3:
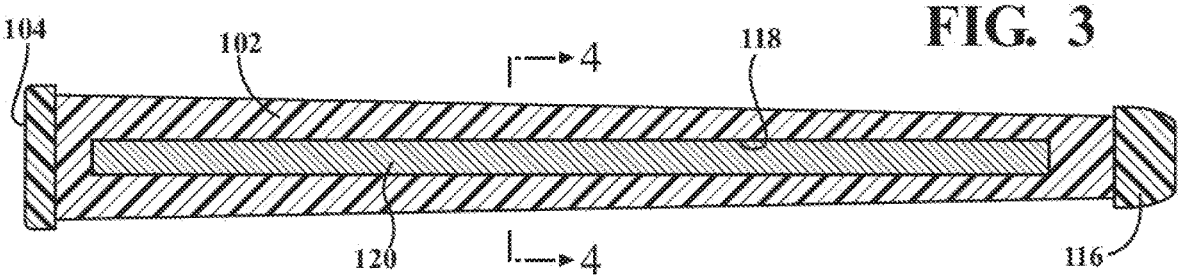
FIG. 3 illustrates a bottom view of the golf grip of FIG. 1 with an outer wrap removed.

The drawings FIGS. 1 to 4 illustrate a first embodiment of a putter type golf grip 100 in accordance with the present invention. As seen in the exploded view of FIG. 2, the golf grip is formed with a light weight, grip body 102, end cap 104 and an outer, over layer wrap 106. The grip 100 includes an upper section or topside 108 and sides 110 extend from the upper section 108 to a rear underside 112 that forms a rearward part of the grip 110. The grip body 102 includes an elongated bore 114 that serves as a shaft encasing, grip opening when the grip 100 is mounted on the shaft of a golf club. The elongated bore 114 is open at a distal end 116 of the grip 100 opposite the end cap 104 to receive the golf club shaft when the grip 100 is connected to a golf club shaft. The grip body 102 is formed of with a channel 118 at the rear underside 112 of the grip body 102.

Figure 4:
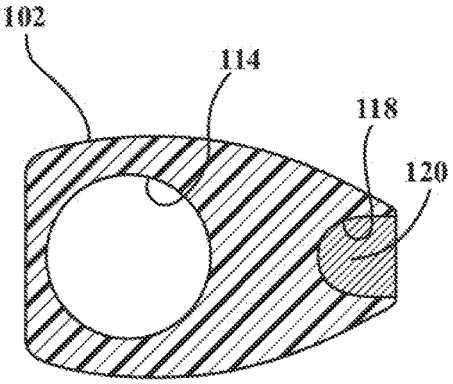
FIG. 4 is a sectional view taken along line 4-4 of FIG. 3.

The outer wrap 106 that forms the outermost layer of the grip 100 may include various gripping patterns and/or distinguishing material such as logos and trademarks. It will be appreciated that the outer layer wrap 106 may be eliminated, for example as shown in FIGS. 3 and 4, whereby the outer layers of the grip body 102 form the outermost areas of the grip 100.

Typically, the grip body 102 is a unitary member including the end cap 104 and the outer wrap 106 that is attached after the grip body 102 is formed by adhesive or a similar connecting means. The outer wrap 106 has a preferable weight of 15 grams.

In a preferred embodiment, the grip body 102 is made of a low density, light material such as light weight foam material or synthetic polymer compound such as EVA foam. A typical, normal sized grip body will weigh approximately 40 grams.

A weight member 120, such as a metal rod made of a material having a significantly heavier density, such as lead, steel or other heavy material, is sized to fit into the opening formed by the channel 118 formed into the rear underside 112 of the grip.

The weight member 120 will weigh between 50 and 120 grams; preferably at least 65 grams. Thus, the weight member 120 represents at least one half and preferably slightly more than the total weight of the remaining parts of the grip 100 while being only approximately 10% of the total volume of the grip 100. It follows a great portion of the entire weight of the grip 100 is concentrated at the rear bottom location of the grip 100 such that the underside section 112 tends to gravitate downwardly due to the force of gravity when the grip 100 is permitted to freely assume a rest position without manipulation by a golfer's hands.

As shown in FIG. 3, the weight member 120, in the form of a heavy rod, extends from just under the closed upper butt end 114 at least 80% of the entire distance between the end cap 104 and the lower distal end 116 of the grip 100.

Typically, the grip 100 is made in a tapered configuration, becoming smaller toward the distal end 116. At an upper end of the grip adjacent the end cap 104, the grip 100 has a thickness of approximately 1.25 inches between the front 108 and the lower rear 112. As the grip 100 tapers toward the distal end 116 the thickness approaches 1.00 inch. In the preferred embodiment described above, the weight member 120 is located approximately 0.5 inches from a golf club shaft when the grip 100 is assembled on a golf club. This distance defines a moment arm that in combination with the weight member 120 creates a MOI value that is significant to overcome any natural tendency of the golf club to turn or twist as it is moved during a putting stroke.

It will be appreciated that the size and material of the weight member 120 will vary the MOI of the golf grip 100. For example, if the thickness of grip is greater, a lesser weight is necessary to achieve the same MOI. It follows that using a same weight member 120 will create a greater MOI when located at an outer location of a larger or thicker grip. Increasing the weight of the weight member 120 either by making it larger or using more dense material also increases the MOI of the grip.

Figure 5:
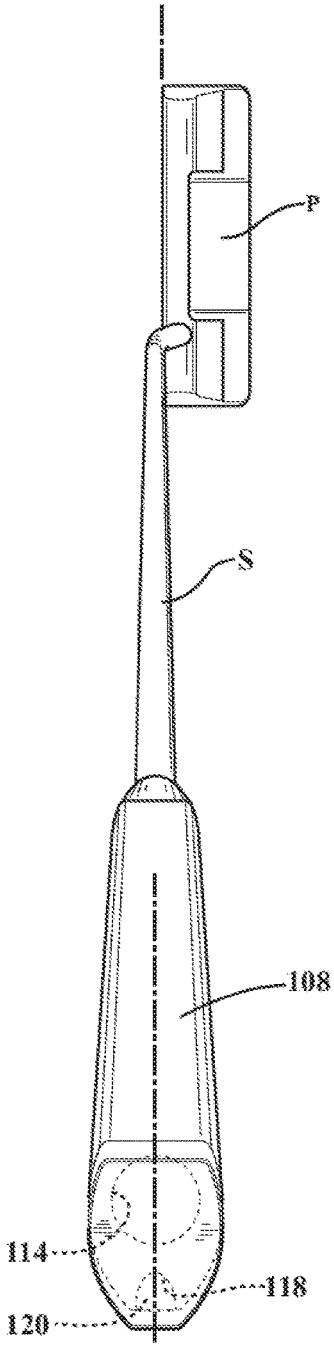
FIG. 5 is a view of the grip assembled on a putter type golf club.

Referring to FIG. 5, a golf grip 100 in accordance with the present invention is shown assembled on a putter 200 having a shaft 202 and a putter head 204 including a striking face 206 that engages a golf ball during the execution of a putting stroke.

The elongated bore 114 of the grip 100 that serves as a shaft opening and a weight member 120 are shown in phantom. A line drawn directly through the center of the elongated bore 114 and the weight member 120 is parallel to the striking face 206 of the putter 200 when the grip 100 is properly aligned and installed on the putter shaft 202. The increased MOI of the grip 100 aids the golfer to maintain the putter striking face 206 at a square position perpendicular to an intended target direction.

Various modifications may be made to the above described invention in keeping with the following claims.

What is claimed is:

1. A grip assembly connectable to a golf club having a shaft, the grip assembly comprising:

a grip body extending between an upper butt end and a distal end, and the grip body has a topside and a pair of sides extending from the topside to a rear underside;

the grip body defining a bore extending between the upper butt end and the distal end, and the bore is sized to receive the shaft of the golf club;

the grip body defining a channel spaced at least 15 mm from a center of the bore, and the channel extends from the upper butt end to adjacent the distal end in an outer surface of the rear underside;

wherein the grip body includes to the upper butt end of the grip body, and an outer wrap permanently encases around an entire circumference of the grip body along a portion of a length of the grip body;

the grip body end cap and the outer wrap define a first volume of material having a first weight;

a rod disposed in the channel, and the rod defines a second volume of material having a second weight;

the first volume of material and the second volume of material comprises a total volume and a total weight of the grip assembly, and the first volume of material is approximately 90% of the total volume and the second volume of material is approximately 10% of the total volume, and the second weight is greater than the first weight.

2. The grip assembly of claim 1 wherein the grip body and the outer wrap have a total weight which is not greater than 60 grams.

3. The grip assembly of claim 2 wherein said second weight is between 50 and 170 grams.

4. The grip assembly of claim 2 wherein said second weight is not less than 65 grams.

5. The grip assembly of claim 1 wherein the grip body is of a material 50 to 85 times lighter per cubic inch than the rod.

6. The grip assembly of claim 1 wherein at least 70% of the total weight of the grip assembly is below the center of the bore.

7. A golf club assembly comprising:

a putter-type head presenting a face disposed in a first vertical plane and a shaft extending upwardly therefrom to a distal head end;

a grip coupled to the distal head end;

the grip having a grip body extending between an upper butt end and a distal grip end to define a first length, and the grip body has a topside and a pair of sides extending from the topside to a rear underside;

the grip body defining a bore extending along a second vertical plane between the upper butt end and the distal grip end for receiving and connecting the grip body to the shaft such that the second vertical plane is parallel to the first vertical plane;

the grip body defining a channel spaced below and at least 15 mm from a center of the bore and extending along the second vertical plane a second length from the upper butt end to adjacent the distal grip end in an outer surface of the rear underside;

the second length being at least 80% of the first length;

the grip having an end cap connected to the upper butt end of the grip body;

wherein an outer wrap permanently encases around an entire circumference of the grip body along a portion of a length of the grip body;

the grip body and the end cap and the outer wrap define a first volume of material having a first weight;

the grip having a rod having the second length and permanently disposed in the channel, and the rod defines a second volume of material having a second weight;

the second length being at least 80% of the first length; and the first volume of material and the second volume of material comprising a total volume and weight of the grip, and the first volume of material is approximately 90% of the total volume and the second volume of material is approximately 10% of the total volume, and the second weight is greater than the first weight.

8. The golf club assembly of claim 7 wherein the grip body and the outer wrap have a total weight which is not greater than 60 grams.

9. The golf club assembly of claim 8 wherein said second weight is between 60 and 170 grams.

10. The golf club assembly of claim 8 wherein said second weight is not less than 65 grams.

11. The golf club assembly of claim 7 wherein the grip body is of a material 50 to 85 times lighter per cubic inch than the rod.

12. The golf club assembly of claim 7 wherein at least 70% of a total weight of the grip assembly is below the center of the bore.

13. The golf club assembly of claim 7 wherein said second weight is approximately 65 grams.

14. A grip assembly connectable to a golf club having a shaft, the grip assembly comprising:

a grip body extending between an upper butt end and a distal end to define a first length, and the grip body has a topside and a pair of sides extending from the topside to a rear underside;

the grip body defining a bore extending between the upper butt end and the distal end for receiving the shaft of the golf club;

the grip body defining a channel spaced at least 15 mm from a center of the bore, and the channel extends a second length from the upper butt end to adjacent the distal end; in an outer surface of the rear underside; wherein an end cap is connected to the upper butt end of the grip body, and an outer wrap permanently encases around an entire circumference of the grip body along a portion of a length of the grip body; the grip body, end cap and the outer wrap define a first volume of material having a first weight the second length being at least 80% of the first length;

a rod disposed in the channel, and the rod defines a second volume of material having a second weight;

the first volume of material and the second volume of material comprising a total volume and weight of the grip assembly, and the first volume of material is approximately 90% of the total volume and the second volume of material is approximately 10% of the total volume, and the second weight is greater than the first weight; and wherein the grip body is of a material 50 to 85 times lighter per cubic inch than the rod.

15. The grip assembly of claim 14 wherein the grip body and the outer wrap have a total weight which is not greater than 60 grams.

16. The grip assembly of claim 15 wherein said second weight is between 50 and 170 grams.

17. The grip assembly of claim 15 wherein said second weight is not less than 65 grams.

* * * * *